United States Patent [19]

Darling

[11] 3,991,647

[45] Nov. 16, 1976

[54] METHOD AND APPARATUS FOR ATTACHING HAIRS TO A BOW FOR A STRINGED INSTRUMENT

[75] Inventor: Myron E. Darling, Webster City, Iowa

[73] Assignee: B.J.D. Industries, Blairsburg, Iowa

[22] Filed: May 5, 1975

[21] Appl. No.: 574,274

[52] U.S. Cl. ..... 84/282

[51] Int. Cl.[2] ..... G10D 1/02

[58] Field of Search ..... 84/282

[56] References Cited

UNITED STATES PATENTS

| | | | |
|---|---|---|---|
| 564,448 | 7/1896 | Nelson | 84/282 |
| 833,463 | 10/1906 | Kane | 84/282 |
| 965,072 | 7/1910 | Bryant | 84/282 |
| 1,427,851 | 9/1922 | Rigg | 84/282 |
| 1,686,554 | 10/1928 | Gray | 84/282 |

FOREIGN PATENTS OR APPLICATIONS

| | | | |
|---|---|---|---|
| 6,221 | 1914 | United Kingdom | 84/282 |

*Primary Examiner*—Stephen J. Tomsky
*Attorney, Agent, or Firm*—Henderson, Strom & Sturm

[57] ABSTRACT

A method and apparatus for connecting hairs to a bow of a type including a drilled bore of a novel configuration and orientation in one end of the bow. A helical member fits over the ends of a plurality of hairs to thereby clamp such hairs together. The helical member and the one end of the hairs are then positioned in the bore and such structure is held securely in the bore by the pressure caused by the tautness of the hair when stretched and connected to the other end of the bow.

5 Claims, 8 Drawing Figures

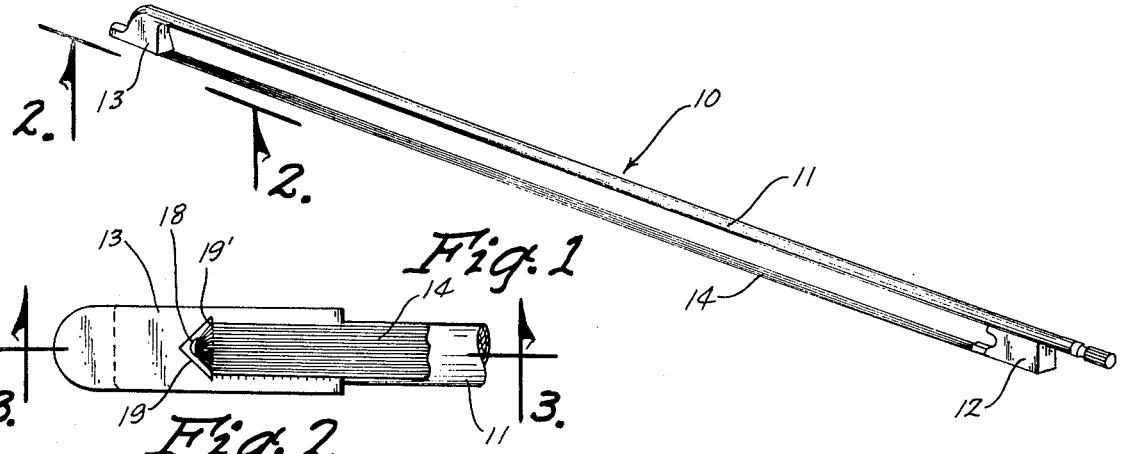
Fig. 1
Fig. 2
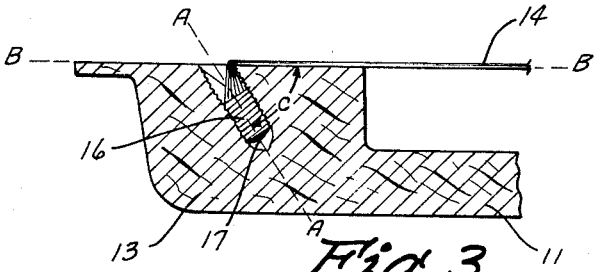
Fig. 3
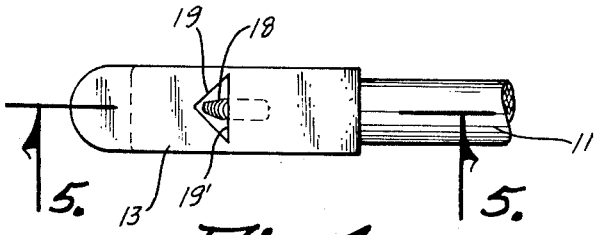
Fig. 4
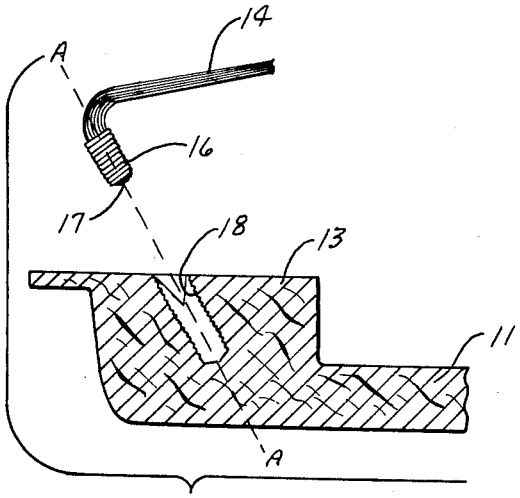
Fig. 5
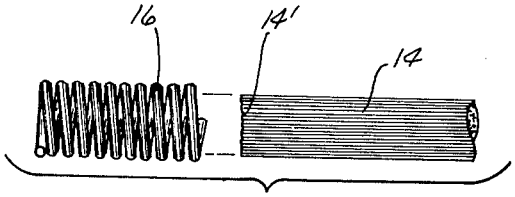
Fig. 6
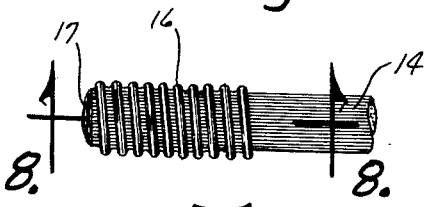
Fig. 7
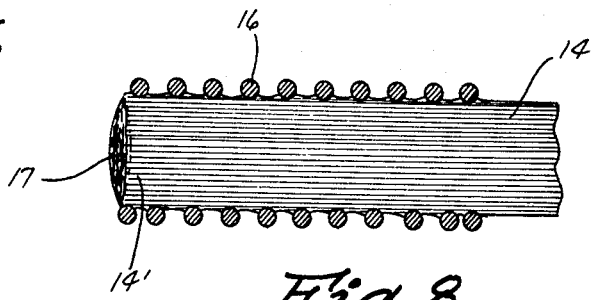
Fig. 8

METHOD AND APPARATUS FOR ATTACHING HAIRS TO A BOW FOR A STRINGED INSTRUMENT

BACKGROUND OF THE INVENTION

The present invention relates generally to a method and apparatus for stringing hair on a bow for a stringed instrument, and more particularly to a bow string fastening device and method of connecting hairs to a bow without the use of special tools.

The conventional method of connecting hairs to the front end of the bow is to first tie the hairs in a knot at one end thereof. The knot is then placed into a depression in the front end of the bot. The next step is to precisely cut a wedge to the exact size needed. The wedge is then pressed into the top of the depression in the bow and over the knot to thereby secure the end of the hairs and the knot to the end of the bow. This conventional method is time consuming and is somewhat cumbersome, especially because the cutting of the wedge to the proper size is difficult and is usually done by trial and error. If too much is cut off of the wedge during this process, the process of forming a wedge must begin anew. Accordingly, it requires a great deal of experience to become efficient and effective in utilizing this conventional method of hairing a bow.

Other methods of connecting hairs to a bow for a stringed instrument have been devised, such as those devices and methods disclosed in U.S. Pat. Nos. 390,279; 508,741; 1,427,851; 1,566,914 and 2,478,027 which require screws of some sort or members which must be clamped together with a tool. It would be desirable, however, to be able to connect hairs to a bow end without utilizing specially constructed members or clamping tools.

SUMMARY OF THE INVENTION

The present invention relates to a method and apparatus for connecting the hairs of a bow for a musical stringed instrument to one end of the bow. The hair is first gathered together and the one end of the hairs are tied with a thread. A helical member resembling or being a coil spring is then screwed onto the tied end of the hairs. A small amount of glue is then applied to the extreme one end of the hairs having the helical member thereon.

A bore is formed in one end of the bow, preferably in advance of the above steps. This bore has screw threads thereon preferably in the same direction and complementary with the pitch and direction of the convolutions of the helical member. Furthermore this bore is formed at an angle which is substantially less than 90° from the line which define the proper position of the hair when strung. The helical member and therefore the one end of the hairs are then placed into the bore. The other end of the hairs are then pulled together and connected to the other end of the bow by any of the methods known in the prior art.

An object of the present invention is to provide an apparatus and method for attaching the hairs of a bow for a stringed instrument without the use of special tools.

Another object of the invention is to provide a structure for securing one end of the hairs of a bow by utilizing the tautness of the hairs themselves when the other end of the hairs is connected to the other end of the bow.

A further object of the invention is to eliminate the need for screws or wedges used in the prior art for attaching hairs to a bow.

Other objects, advantages, and novel features of the present invention will become apparent from the following detailed description of the invention when considered in conjunction with the accompanying drawings.

BRIEF DESCRIPTION OF THE DRAWINGS

FIG. 1 is a perspective view of a bow for use with a stringed instrument constructed according to the present invention;

FIG. 2 is a partial view of the front end of the bow of FIG. 1 taken along line 2—2 of FIG. 1;

FIG. 3 is a cross-sectional view taken along line 3—3 of FIG. 2;

FIG. 4 is a view like FIG. 2, but without showing the hairs attached to the bow;

FIG. is a cross-sectional view like FIG. 3, but showing the hairs in readiness to be attached to the front end of the bow;

FIG. 6 is a view of one end of the hairs of the bow having a helical member shown in readiness to be attached thereto;

FIG. 7 is a view of the helical member having been screwed onto the ends of the hairs; and FIG. 8 is a cross-sectional view taken along line 8—8 of FIG. 7 and showing the helical member in cross-section and some glue placed on the end of the hairs.

DESCRIPTION OF THE PREFERRED EMBODIMENT

Referring now to the drawings wherein like reference numerals designate identical or corresponding parts throughout the several views, FIG. 1 shows a bow 10 constructed to the present invention. The bow has a main shaft section 11. A frog 12 is connected to the rear end of the shaft 11 and a front portion 13 is connected to the other end of the bow shaft 11. A plurality of hairs 14, sometimes collectively referred to as a string, is connected at one end to the frog 12 and at the other end to the front portion 13 of the bow 10.

Normally the hairs to be used for a bow string are purchased in quantity. This hair is normally from the tail of a horse, but certain other materials such as synthetic fibers have also been used. The proper quantity of hairs to be placed on a bow is gathered together, for example as shown in FIG. 6. For example, 150 hairs approximately might be used for this purpose.

Once the hairs are collected together at one end, a thread (not shown) is utilized to tie the hairs together adjacent the one end 14'. Once this has been done, a spring 16 is screwed onto the end 14' of the hairs 14 as shown in FIGS. 6 and 7 by rotating the spring and forcing the end 14' into the spring 16. The ideal size for the spring 16 is a number eight with an inside diameter of 0.190. This spring will be approximately one-eighth of an inch long. The actual size and configuration of the spring is not critical so long as it is reasonably close to this size given. Once the spring 16 has been placed in the position shown in FIG. 7, some glue 17 is placed on the extreme end 14' of the hairs 14. This glue 17 serves to bond all of the hairs 14 together with the inside to the outside, such that they are all held securely together by the spring 16. It is to be understood that the steps involving the thread and the glue are preferable, but optional.

The construction of the portion 13 of the bow 10 is very important because of the way in which it cooperates with the end 14' of the string 14. A bore 18 is tapped into the end 13 along the center line A—A. It is important that this bore 18 be oriented such that the angle between line A—A and B—B, which line designates generally the line corresponding to the hairs 14 as strung on the bow in FIG. 1, is substantially less than 90° . This angle is indicated by the letter C in FIG. 3. This angle C is important because when the hairs 14 are stretched and connected to the frog 12, the pressure and tautness thereof tends to hold the ends of the hair 14' within the opening because of such configuration.

Another important feature of the bore 18 is the thread-like configuration of the inner periphery thereof. This inner periphery of the bore 18 resembles the interior of a nut designed to be threaded onto a bolt. The pitch and configuration of the threads within the bore 18 are designed to be in the same direction as the convolutions of the spring 16, in the same way that the threads of a mating nut and bolt would be both right hand threads and not one right hand and the other left hand.

Another important feature of the bore 18 is the configuration of the top 19 thereof which is of a configuration as viewed in FIG. 4. The important aspect of this triangular section 19 is the fact that the front side 19' is straight such that the hairs are spread out across the flat surface 19' as clearly shown in FIG. 2.

It is also important that the bore 18 be slightly oversize with respect to the outer diameter of the spring 16. This is important to facilitate easy connecting and disconnecting of the string 14 from the end portion 13 of the bow 10. In order to actually connect the end 14' to the front portion of the bow 10, the spring 16 and the hair 14 is moved to the position as shown in FIG. 5 with respect to the end 13 of the bow 10. The spring 16 is then inserted along the dotted line A—A to the position as shown in FIG. 3. This may be done manually, of course, since the bore 18 is slightly larger than the spring 16. Once this has been done the hair 14 can be stretched as shown in FIG. 2 and then connected to the frog 12 in any well known manner. The preferable way of connecting the hairs 14 to the frog 12, however, is shown in co-pending patent application Ser. No. 489,822, now Pat. No. 3,919,912. Accordingly, it can be seen that the disclosed method and apparatus does indeed accomplish the aforementioned objects.

Obviously many modifications and variations of the present invention are possible in light of the above teachings. It is therefore to be understood that, within the scope of the appended claims, the invention may be practiced otherwise than as specifically described.

I claim:

1. In a bow for stringed instruments having hair stretched between a rear end and a forward end, the improvement comprising;

a bore having screw threads around the periphery thereof disposed in one end of said bow, the angle between the stretched portion of the hair and the longitudinal axis of said bore being substantially less than 90° ;

a member disposed around one end of the hair, said member having an irregular surface on the exterior thereof, said member and said one end of the hair being disposed in said bore.

2. The device as claimed in claim 1 wherein said member is of a helical configuration.

3. The device as claimed in claim 2 wherein the direction of the pitch of the helical member is complementary to the direction of the pitch of the screw threads.

4. The device as claimed in claim 1 wherein the top of said bore has a straight edge over which the hair is stretched.

5. The method of stringing a bow for a stringed instrument comprising:

gathering a plurality of hairs to be strung on the bow;

screwing a helical member on said one end of the hairs;

forming a bore opening slightly larger than the diameter of the helical member in one end of the bow at an angle of substantially less than 90° from a line defining the proper position of the intermediate portion of hair when strung;

placing said helical member and said one end of the string in said bore;

stretching the hairs to the other end of the bow; and connecting the other end of the hair to the other end of the bow.

* * * * *